US006969281B2

(12) United States Patent
Lai

(10) Patent No.: US 6,969,281 B2
(45) Date of Patent: Nov. 29, 2005

(54) ALL-IN-ONE CARD CONNECTOR HAVING CONTACT PINS SHARED BY MULTIPLE TERMINALS

(75) Inventor: Yaw-Huey Lai, Taipei (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 10/872,452

(22) Filed: Jun. 22, 2004

(65) Prior Publication Data

US 2005/0239334 A1 Oct. 27, 2005

(30) Foreign Application Priority Data

Apr. 22, 2004 (TW) ..... 93206242 U

(51) Int. Cl.[7] ..... H01R 24/00

(52) U.S. Cl. ..... 439/630; 439/945

(58) Field of Search ..... 439/630, 945, 439/946; 235/441

(56) References Cited

U.S. PATENT DOCUMENTS

| | | | | |
|---|---|---|---|---|
| 6,086,425 | A * | 7/2000 | Lescoat | 439/630 |
| 6,146,195 | A * | 11/2000 | Chang | 439/541.5 |
| 6,386,920 | B1 * | 5/2002 | Sun | 439/630 |
| 6,773,308 | B2 * | 8/2004 | Lwee | 439/630 |
| 6,830,474 | B2 * | 12/2004 | Liu et al. | 439/489 |

* cited by examiner

*Primary Examiner*—Hae Moon Hyeon
(74) *Attorney, Agent, or Firm*—Bacon & Thomas, PLLC

(57) ABSTRACT

An all-in-one card connector is comprised of a base, a circuit board, a plurality of terminals, and a plurality of pins. The circuit board is mounted on the base, including a plurality of contacts, which are sectioned into at least two groups respectively matching at least two kinds of electronic cards and partially electrically interconnected therebetween, and a plurality of pin solder joints provided at a rear end thereof and respectively electrically connected to some of the contacts of the circuit board. The terminals are electrically connected to the contacts. The pins are welded to the pin solder joints. Accordingly, each pin is shared by some of the contacts such that the requirement for the number of the pins can be reduced, and further, the size or width of the card connector can be lessened.

4 Claims, 6 Drawing Sheets

ALL-IN-ONE CARD CONNECTOR HAVING CONTACT PINS SHARED BY MULTIPLE TERMINALS

BACKGROUND OF THE INVENTION

1. Field of the Invention

The present invention relates generally to electronic devices, and more particularly to an all-in-one connectors having pins that are shared by multiple terminals.

2. Description of the Related Art

A currently commercially available all-in-one card connector is compatible with the specifications of multiple memory cards, such as MS (Memory Stick), SM (Smart Media), MMC (Multi Media Card), SD (Secure Digital), etc. However, the memory cards respectively have different numbers and locations of the contacts, such that numerous sets of the terminal contacts must be mounted on the card connector to match the contacts of the multiple memory cards, wherein the number of the terminal contacts is equal to the total number of the contacts of the multiple memory cards. In other words, if the conventional all-in-one card connector is compatible with four kinds of memory cards, the number of the terminal contacts is equal to the total number of the contacts of the four memory cards, and the pins disposed at the bottom edge of the card connector, as known in the prior art, are connected to all terminal contacts one by one.

Referring to FIGS. 5 and 6, a conventional four-in-one card connector 70 is comprised of forty pins 71, being the typical card connector, which pins 71 are connected to the terminal contacts 74 one by one, i.e. each kind of the memory cards corresponds to the predetermined numbers of the pins 74 and the terminal contacts 74, which are not overlapped or connected therebetween. However, if the specification of the fifth kind of the memory card is included in such kind of card connector 70, there will be fifty pins 71 for the requirement, thereby causing too many pins 71 of the card connector 70. Because a predetermined interval must be kept between each two pins, the card connector 70 cannot be reduced or may even be enlarged in size or width. Further, although decreasing the interval can reduce the width slightly, the overmuch small interval may render the difficulty for the production and the coplanarity of the pins 71.

SUMMARY OF THE INVENTION

The primary objective of the present invention is to provide an all-in-one card connector, which pins are shared by terminals to reduce the number of the pins to further reduce the size and the width of the card connector.

The secondary objective of the present invention is to provide an all-in-one card connector, which interval between each two pins is unnecessarily reduced to be easily manufactured.

The foregoing objectives of the present invention are attained by the all-in-one card connector, which is comprised of a base, a circuit board, a plurality of terminals, and a plurality of pins. The base is provided with a space formed at a center thereof and having an insertion slot for inserting at least one electronic card, two guide channels respectively formed at bilateral inner side walls thereof abutting the space, and at least two subspaces respectively defined in the space between the two guide channels and the two inner side walls and having different width for accommodating electronic cards of different specifications. The circuit board is mounted on the base, including a plurality of contacts, which are sectioned into at least two groups respectively matching at least two kinds of the electronic cards and partially electrically interconnected therebetween, and a plurality of pin solder joints provided at a rear end thereof and respectively electrically connected to some of the contacts. The terminals are electrically connected to the contacts, partially extending into the space. The pins are welded to the pin solder joints.

DETAILED DESCRIPTION OF PREFERRED EMBODIMENTS

Figure 1:
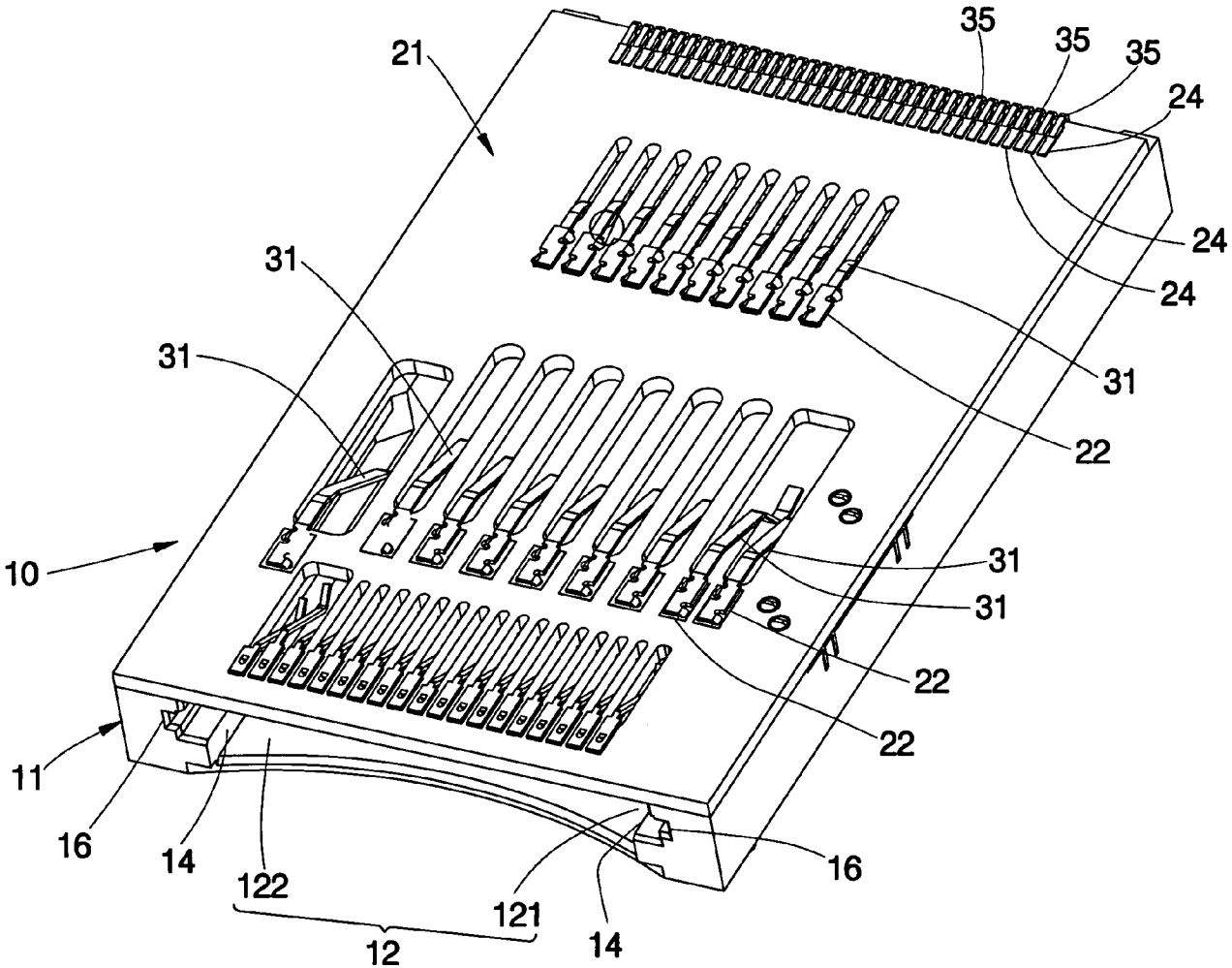
FIG. 1 is a perspective view of a first preferred embodiment of the present invention.
Figure 2:
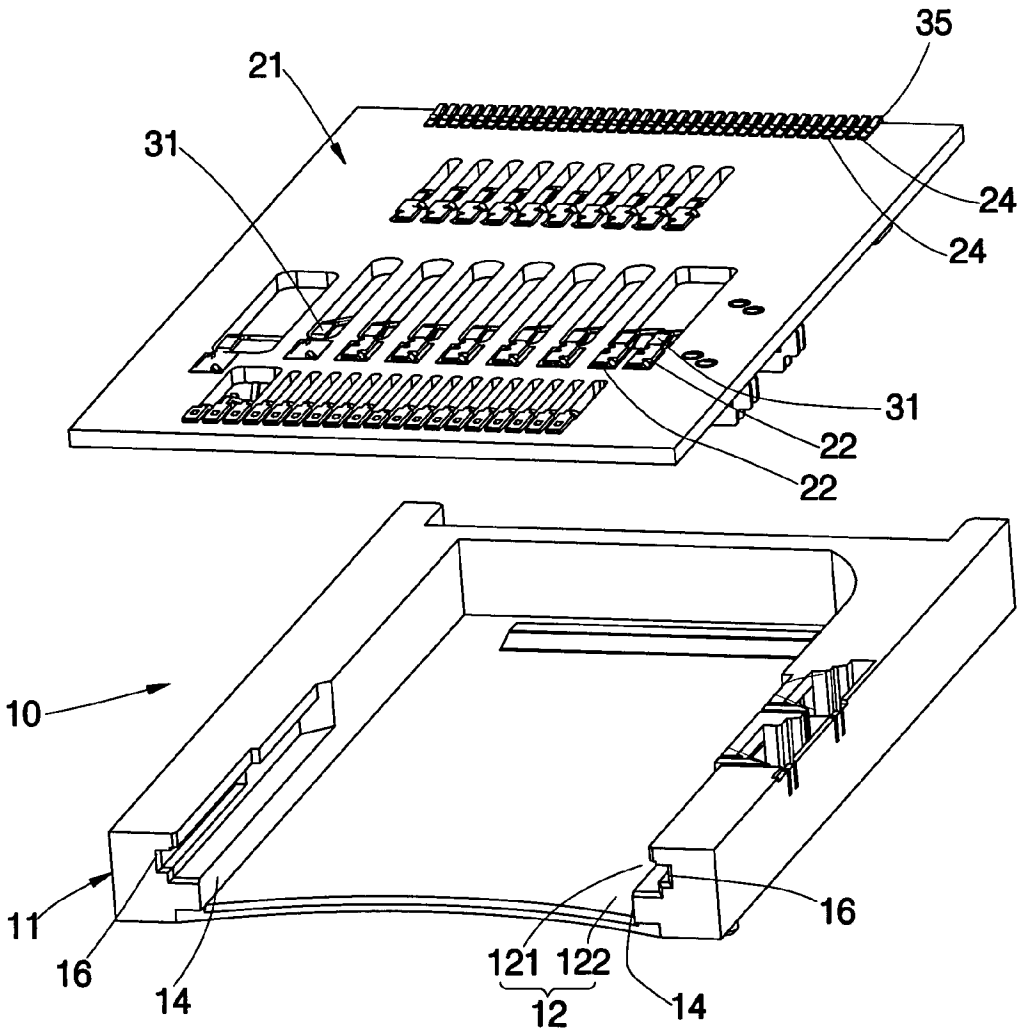
FIG. 2 is an exploded view of the first preferred embodiment of the present invention.
Figure 3:
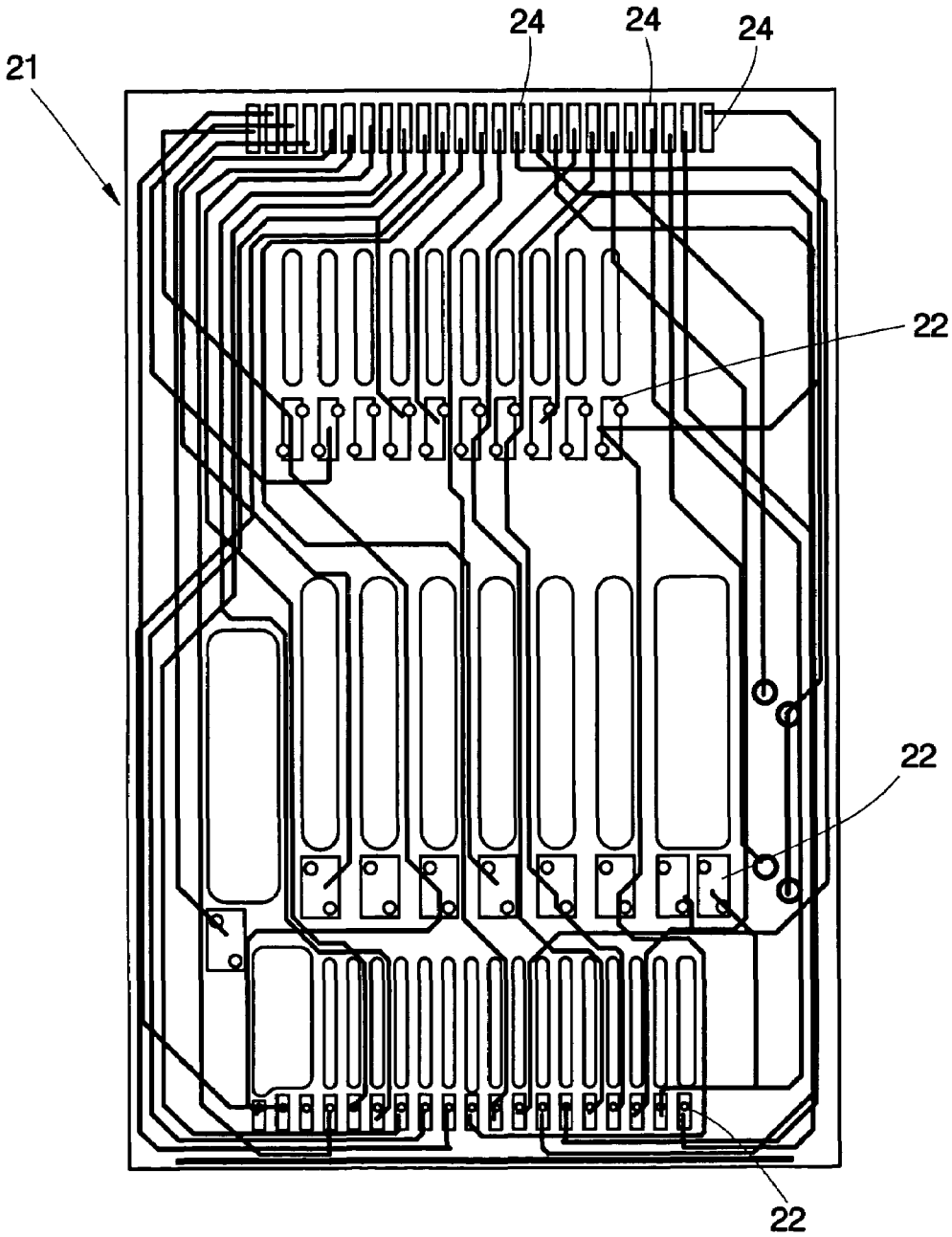
FIG. 3 is a circuit pattern of the first preferred embodiment of the present invention.

Referring to FIGS. 1–3, an all-in-one card connector 10 constructed according to a first preferred embodiment of the present invention is comprised of a base 11, a circuit board 21, a plurality of terminals 31, and a plurality of pins 35.

The base 11 is provided with a space 12 formed at a center thereof, an insertion slot formed at a front end thereof for inserting at least one electronic card (not shown), two guide channels 16 formed at bilateral inner side walls 14 abutting the space 12, and at least two subspaces 121 and 122 respectively defined in the space 12 between the bilateral inner side walls 14 and the two guide channels 16 and having two different width for accommodating two the electronic cards (not shown) of different specifications.

The circuit board 21 is mounted on the base 11, including a plurality of contacts 22, which are sectioned into three groups respectively matching four kinds of electronic cards, wherein one of the groups is shared by SD card and MMC card and some of the contacts 22 are electrically connected to each other. A plurality of pin solder joints 24 are provided at a rear end of the circuit board 21 and are respectively electrically connected to of the contacts including some of the contacts that are connected to each other.

Each of the terminals 31 includes an end mounted on the circuit board 21, electrically connected to the contacts 22 of the circuit board 21, and a body portion extending into the space 12.

The pins 35 are welded to the pin solder joints 24.

Referring to FIG. 3 again, because some of the contacts 22 in each group are electrically interconnected therebetween, i.e. some of the pins 35 are shared by the contacts 22 of each group. Therefore, only twenty-five pins 35 are required for the present invention to dramatically reduce the overall width or size of the all-in-one card connector 10, rather than forty pins required for the conventional card connector. Further, it is unnecessary to reduce the interval between each two pins 35 to incur the difficulty for the production. In addition, the terminals 31, which are connected to the shared contacts 22, will generate corresponding functions while different electronic cards are inserted into the card connector 10. For examples, when an electronic card A (not shown) is inserted, some of the terminals 31 transmit signals; when another electronic card B (not shown) is inserted, some of the terminals 31 transmit power. In other words, the terminals 31 are provided neither exclusively for transmitting signals nor exclusively for transmitting power.

Figure 4:
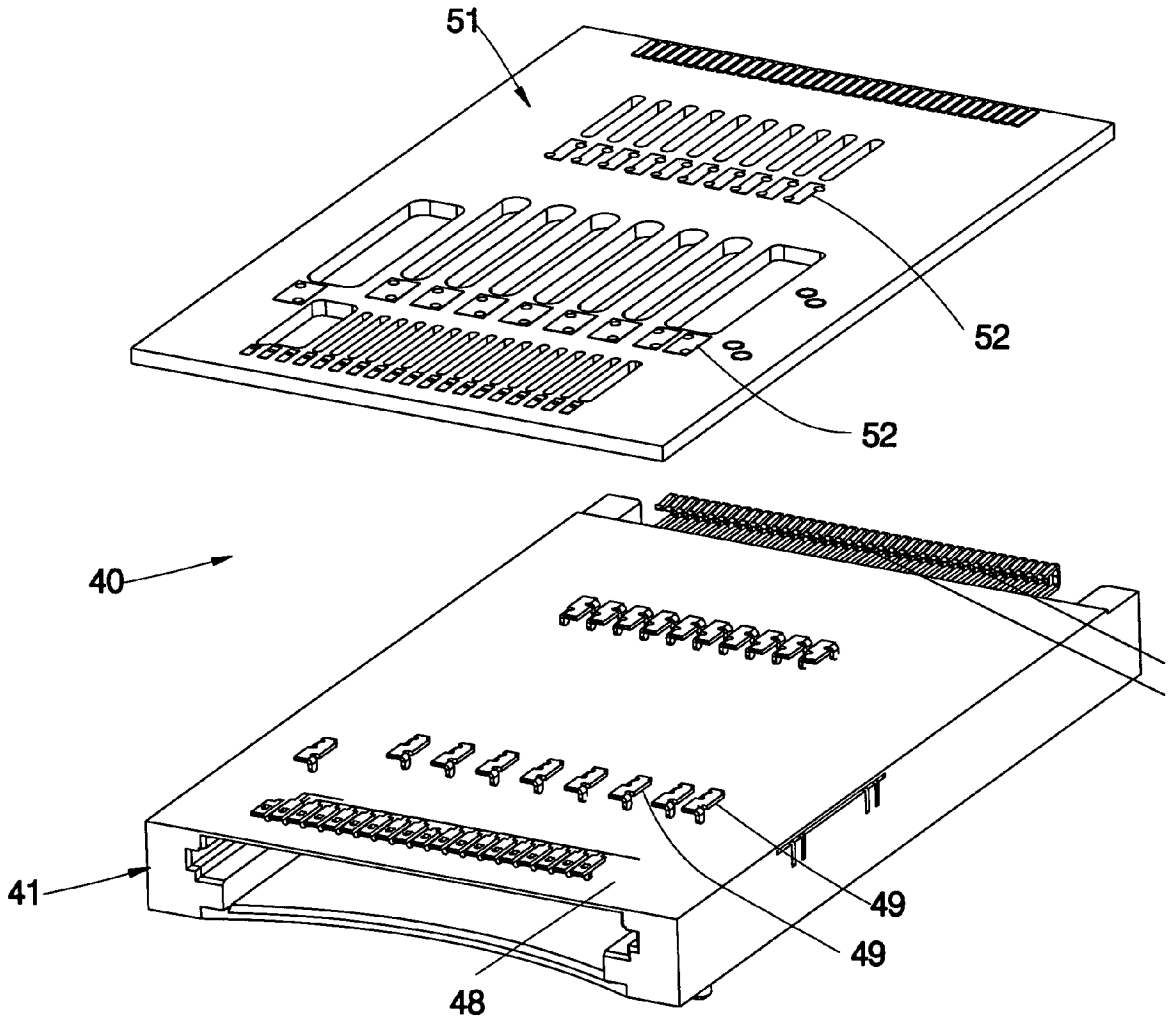
FIG. 4 is an exploded view of a second preferred embodiment of the present invention.
Figure 5:
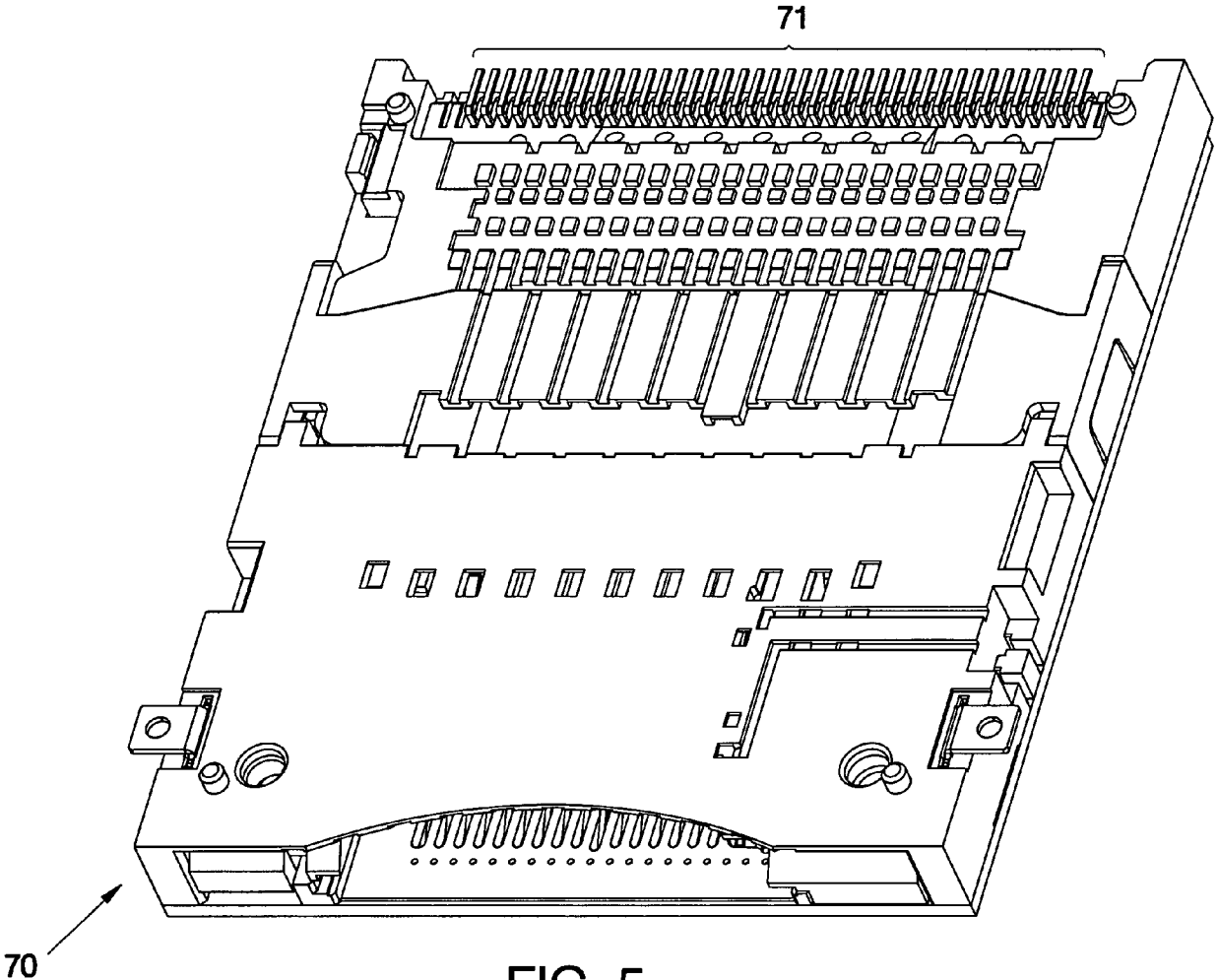
FIG. 5 PRIOR ART
FIG. 5 is a perspective view of the prior art.
Figure 6:
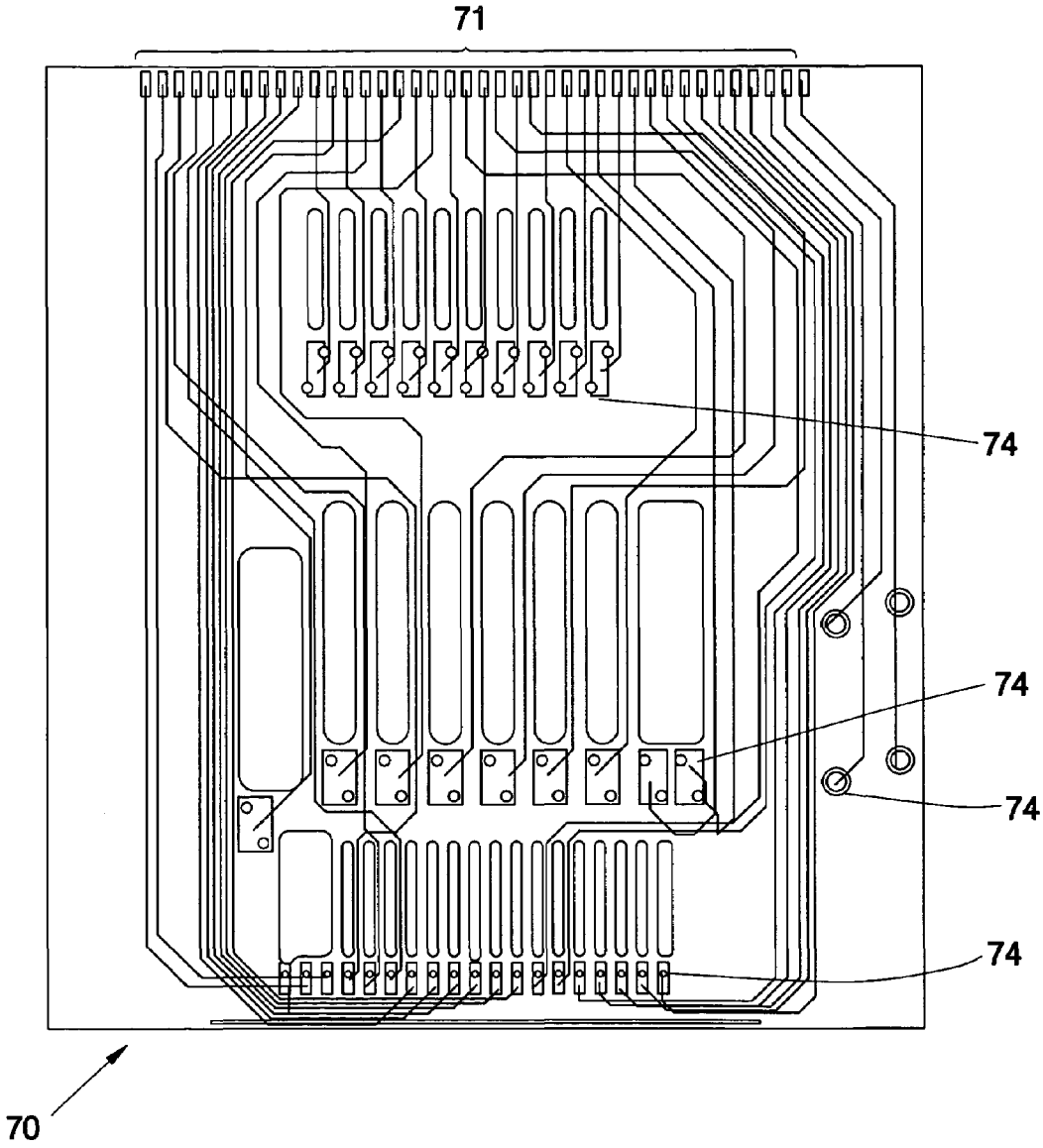
FIG. 6 PRIOR ART
FIG. 6 is a circuit pattern of the prior art.

Referring to FIG. 4, the all-in-one card connector 40 constructed according to a second preferred embodiment of the present invention is similar to the aforementioned preferred embodiment, having difference recited below.

The base 41 further includes a plate-like member 48 on which the circuit board 51 is mounted. Each terminal 49 is mounted on the plate-like member 48 and is electrically connected to the contacts 52 of the circuit board 51. Accordingly, the terminals 49 can be directly mounted on the plate-like member 48 of the base 41 so as to be conveniently welded to the circuit board 51 once, and alternatively, the welding furnace can be applied for the production to attain the same result of reducing the number of the pins.

In conclusion, the present invention includes advantages as follows.

1. The contacts corresponding to various kinds of the electronic cards are partially shared by the pin solder joints to reduce the requirement for the number of the pins to further facilitate the processing and the coplanarity of the pins.

2. Pursuant to the above, the requirement for the number of the pins is reduced to lessen the size and the width of the card connector.

3. Pursuant to the above, the requirement for the number of the pins is reduced such that it is unnecessary to reduce the interval between each two pins and no difficulty for the production will be incurred.

What is claimed is:

1. An all-in-one card connector comprising:

a base having a space formed at a center thereof, an insertion slot formed at a front end thereof for inserting an electronic card, two guide channels formed at bilateral inner side walls thereof abutting said space, and at least two subspaces of different width for accommodating electronic cards of different specifications;

a circuit board mounted on said base and having a plurality of contacts provided thereon and a plurality of pin solder joints provided at a rear end thereof, said contacts being sectioned into at least two groups to match electronic cards of at least two specifications, at least some of said contacts being connected to each other, said pin solder joints being electrically connected to said contacts;

a plurality of terminals electrically connected to said contacts of said circuit board and each extending into said space of said base; and a plurality of pins welded to said pin solder joints wherein at least some of said plurality of pins share multiple terminals via said contacts that are connected to each other.

2. The all-in-one card connector as defined in claim 1, wherein each of said terminals is mounted on said circuit board.

3. The all-in-one card connector as defined in claim 1, wherein said base further comprises a plate-like member; said circuit board is mounted on said plate-like member; and each of said terminals is mounted on said plate-like member.

4. The all-in-one card connector as defined in claim 1, wherein some of said terminals are provided for transmitting signals while an electronic card is inserted into said card connector, and for transmitting power or other signals while another electronic card is inserted into said card connector.

* * * * *